US008569637B2

(12) United States Patent
Byeon

(10) Patent No.: US 8,569,637 B2
(45) Date of Patent: Oct. 29, 2013

(54) INTERLOCK APPARATUS FOR SOLID INSULATED SWITCHGEAR

(75) Inventor: Jeong Mu Byeon, Gangwon-Do (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 199 days.

(21) Appl. No.: 13/158,293

(22) Filed: Jun. 10, 2011

(65) Prior Publication Data

US 2011/0303518 A1 Dec. 15, 2011

(30) Foreign Application Priority Data

Jun. 10, 2010 (KR) ..... 10-2010-0055033

(51) Int. Cl.
*H01H 13/72* (2006.01)
*H01H 13/76* (2006.01)
*H01H 9/26* (2006.01)

(52) U.S. Cl.
USPC ..... 200/5 B

(58) Field of Classification Search
USPC ..... 200/5 B, 400, 43.16, 43.01, 50.16, 200/50.17, 50.21, 50.24, 50.27, 50.3, 50.32, 200/50.39, 50.4, 431, 318, 318.1, 320, 324
See application file for complete search history.

(56) References Cited

U.S. PATENT DOCUMENTS 3,573,560 A * 4/1971 Rogers ..... 361/609
4,798,922 A * 1/1989 Roberts ..... 200/400
4,827,088 A * 5/1989 Oakes et al. ..... 200/18
7,977,595 B2 * 7/2011 Lee et al. ..... 200/400
8,237,070 B2 * 8/2012 Zhang ..... 200/50.32

FOREIGN PATENT DOCUMENTS

CN 101304165 11/2008
KR 20-0183457 * 5/2000
KR 200183457 5/2000

OTHER PUBLICATIONS

The State Intellectual Property Office of the People's Republic of China Application Serial No. 201110211534.5, Office Action dated Jul. 22, 2013, 8 pages.

* cited by examiner

*Primary Examiner* — Edwin A. Leon
*Assistant Examiner* — Anthony R. Jimenez
(74) *Attorney, Agent, or Firm* — Lee, Hong, Degerman, Kang & Waimey

(57) ABSTRACT

For a solid-insulated switchgear in which a main circuit switching mechanism and a ground circuit switching mechanism are provided laterally, and there is disclosed an interlock apparatus for the solid-insulated switchgear comprising a first interlock mechanism connected to a switching shaft of the ground circuit switching mechanism to press the on shaft of the main circuit switching mechanism to be at the locking position or release the on shaft of the main circuit switching mechanism; and a second interlock mechanism connected to the switching shaft of the main circuit switching mechanism in an interlocking manner to press the on shaft of the ground circuit switching mechanism to be at the locking position or release the on shaft of the ground circuit switching mechanism.

7 Claims, 12 Drawing Sheets

INTERLOCK APPARATUS FOR SOLID INSULATED SWITCHGEAR

RELATED APPLICATION

This application claims the benefit of Korean Patent Application No. 10-2010-0055033, filed on Jun. 10, 2010, which is hereby incorporated by reference for all purposes as if fully set forth herein.

BACKGROUND OF THE INVENTION

1. Field of the Invention

The present invention relates to a solid insulated switchgear, and more particularly, to an interlock apparatus for an solid-insulated switchgear.

2. Description of the Conventional Art

Solid-insulated switchgear is a switchgear in which insulation among the phases of the three-phases alternating current by an insulating gas such as a sulfur hexafluoride (SF6) gas is substituted by a solid electrically insulating material such as epoxy, which is used as a material in a portion except for the portion requiring electrical conduction of the constituent element, in a sulfur hexafluoride (SF6) gas-insulated switchgear in the related art as one of green house gases the use of which is globally trending toward restrictions. Such a switchgear is typically used in the reception and distribution of electric power lines, branching of a line, and the like.

The present invention relates to an interlocking apparatus, i.e., interlock apparatus, for preventing a main circuit switching mechanism and a ground circuit switching mechanism from being simultaneously closed, in other words, preventing both of the two switching mechanisms from being simultaneously closed in such a manner that the ground circuit switching mechanism is not at the ground position when the main circuit switching mechanism is at the conducting closing position, in a solid-insulated switchgear having a structure in which the main circuit switching mechanism and ground circuit switching mechanism are connected in parallel among the solid-insulated switchgears.

As an example of the interlock apparatus according to the related art, there is Korean Utility Model Registration No. 20-0183457 (Title of the utility model: Mechanical interlock apparatus in air circuit breaker) filed and registered by the applicant of the present invention However, the above introduced interlock apparatus according to the related art has a vertical structure, thus providing an unsuitable structure in applying to a solid-insulated switchgear to which the present invention with a parallel structure is to be applied in which a main circuit switching mechanism and a ground circuit switching mechanism are provided in a horizontal direction. In the aspect of structure, it has a structure to be operated while the link is pulled by a wire, thereby causing a problem that the wire is likely to be cut off by repetitive use of it, the maintenance work is inconvenient due to its complicated structure, and the miniaturized size is not attainable in applying it to a solid-insulated switchgear in which the dimension of the occupied three-dimensional space is limited.

SUMMARY OF THE INVENTION

The present invention is provided to solve the foregoing problems in the related art, and an object of the present invention is to provide an interlock apparatus for a small-sized solid-insulated switchgear with a simple structure that is suitable for a solid-insulated switchgear with a parallel structure in which a main circuit switchgear and a ground circuit switchgear are provided laterally in a horizontal direction.

The objective of the present invention may be accomplished by providing an interlock apparatus for a solid-insulated switchgear in accordance with present invention, the a solid-insulated switchgear having a main circuit switching mechanism and a ground circuit switching mechanism provided laterally in a horizontal direction, wherein the main circuit switching mechanism and ground circuit switching mechanism have a switching shaft, an switching shaft lever supported by the switching shaft to be rotated together, and a closing button for manual closing operation, respectively, and provided with an on shaft having a released position connected to the closing button to release the main circuit switching mechanism and ground circuit switching mechanism to be operated to a closing position and a ground position, respectively, and a locking position for locking the main circuit switching mechanism and ground circuit switching mechanism to prevent them from being operated to a closing position and a ground position, respectively, the interlock apparatus for the solid-insulated switchgear comprising:

a first interlock mechanism provided between the main circuit switching mechanism and ground circuit switching mechanism provided laterally in a horizontal direction and connected to the switching shaft of the ground circuit switching mechanism in an interlocking manner to press the on shaft of the main circuit switching mechanism to be at the locking position or release the on shaft of the main circuit switching mechanism; and a second interlock mechanism provided between the main circuit switching mechanism and ground circuit switching mechanism provided laterally in a horizontal direction and connected to the switching shaft of the main circuit switching mechanism in an interlocking manner to press the on shaft of the ground circuit switching mechanism to be at the locking position or release the on shaft of the ground circuit switching mechanism.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The objective of the present invention, as well as the configuration and working effect thereof to accomplish the foregoing objective will be clearly understood by the following description for the preferred embodiments of present disclosure with reference to the accompanying drawings.

Figure 1:
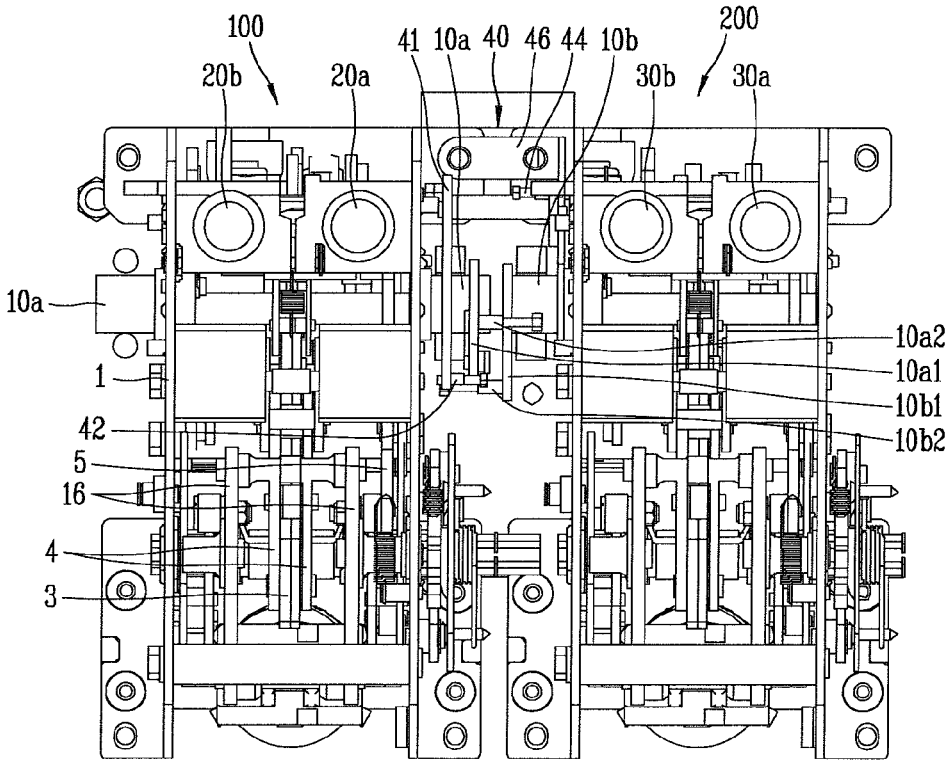
FIG. 1 is a front view illustrating the main configuration of a solid-insulated switchgear comprising a main circuit switching mechanism and a ground circuit switching mechanism, and an interlock apparatus according to the present invention.

A solid-insulated switchgear having an interlock apparatus according to the present invention may be configured such that a ground circuit switching mechanism 100 at the left side and a main circuit switching mechanism 200 at the right side are provided laterally in a horizontal direction as illustrated in FIG. 1. An interlock apparatus 40 according to the present invention may be provided at a middle portion in a horizontal direction between the ground circuit switching mechanism 100 at the left side and main circuit switching mechanism 200 at the right side provided laterally in a horizontal direction.

Prior to describing the configuration and operation of the interlock apparatus 40 according to present invention, the interlock apparatus 40 according to the present invention is an apparatus interlocked with an switching shaft of the ground circuit switching mechanism 100 and main circuit switching mechanism 200 to be worked on an on shaft as described above. Therefore, first, the configuration and operation of the ground circuit switching mechanism 100 and main circuit switching mechanism 200 to which the interlock apparatus 40 according to the present invention is applicable will be described.

The ground circuit switching mechanism 100 and main circuit switching mechanism 200 have the same configuration as illustrated in FIG. 1. However, the main circuit switching mechanism 200 for closing or opening (in other words switching) a main circuit and the ground circuit switching mechanism 100 for closing or opening ((in other words switching) a ground circuit are different in their function.

Accordingly, the configuration and operation of the ground circuit switching mechanism 100 and main circuit switching mechanism 200 will be commonly described with reference to FIGS. 8 through 15.

Referring to the drawings, the ground circuit switching mechanism 100 and main circuit switching mechanism 200 may comprise a fixed contactor 12, a movable contactor 11, an switching shaft 10, an switching shaft lever 10-1, a first link 6, a second link 4, a third link 3, a closing spring section including a closing spring 13 and a closing spring supporting bracket 15, a charging cam 2, a pivotal shaft 2*a*, a driving lever 16, an opening spring 14, a third link biasing spring 15, a closing latch 5, an on shaft 8, an on/off buttons 20*a*, 20*b*, an opening latch 7, and an off shaft 9.

Figure 8:
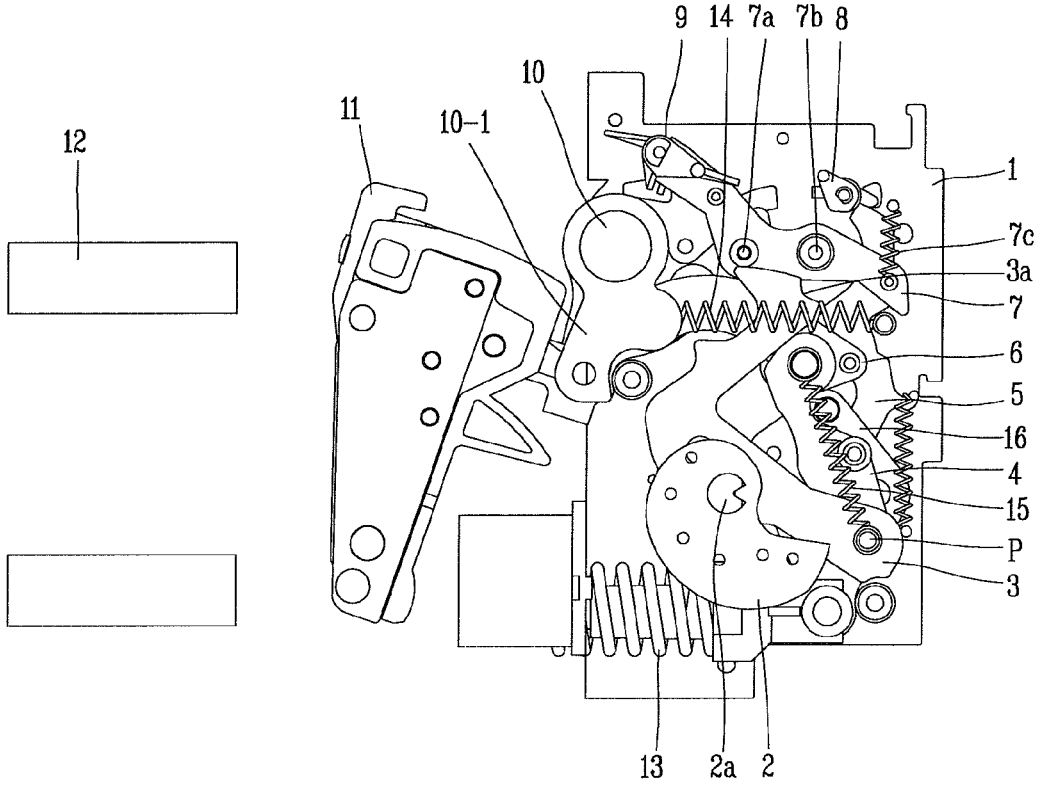
FIG. 8 is a side view of a switching mechanism illustrating the configuration of a main circuit switching mechanism and a ground circuit switching mechanism according to the present invention.

The fixed contactor 12 may be connected to the earth, that is ground in case of the ground circuit switching mechanism 100, and connected to an electric power source side line or an electric load side line of the electric power circuit in case of the main circuit switching mechanism 200. In FIG. 8, a rectangular block at the lower portion having the same shape as the fixed contactor 12 may be connected to the electric power side line or the electric load side line of the electric power circuit in case of the ground circuit switching mechanism 100, and connected to a power side or load side line of the power circuit in case of the main circuit switching mechanism 200, and the relevant rectangular block may be electrically or mechanically connected to the movable contactor 11 through an electrically conductive connector such as a plurality of flexible wires which are not shown in the drawings.

The movable contactor 11 is connected to a switching shaft lever 10-1 and driven to be brought into contact with the fixed contactor 12 or separated from the fixed contactor 12 according to the rotational direction of the switching shaft lever 10-1. When the movable contactor 11 is in a state of being brought into contact with the fixed contactor 12, the electric power source side and electric load side thereof constitute an electrically closed circuit to be in a state of flowing a current therethrough in the main circuit switching mechanism 200, and a circuit is grounded to flow a current to the earth in the ground circuit switching mechanism 100. When the movable contactor 11 is in a state of being separated from the fixed contactor 12, the electric power source side and electric load side thereof are electrically open in the circuit to be in a state that the current flow is cut off in the main circuit switching mechanism 200, and the circuit connection to the earth is cut off and the current flow to the earth is also cut off in the ground circuit switching mechanism 100.

The switching shaft lever 10-1 is typically used for a solid-insulated switchgear to cut off a high-voltage three-phase alternating current circuit, and thus totally three switching shaft levers 10-1 may be provided, one for each phase, to drive the movable contactor 11 for the corresponding phase.

Each of the switching shaft levers 10-1 is coaxially connected to one common switching shaft 10 to drive the three switching shaft levers 10-1 at the same time.

Accordingly, the switching shaft 10 penetrates both side plates 1 supporting the switching mechanism to be connected and extended to the switching shaft lever 10-1 for another phase. Here, the switching shaft 10 is designated as reference numeral 10*a* in case of an switching shaft for the ground circuit switching mechanism 100, and designated as reference numeral 10*b* in case of an switching shaft for the main circuit switching mechanism 200 in a distinguished manner in FIGS. 1 through 7. However, the configuration of the ground circuit switching mechanism 100 is the same as the main circuit switching mechanism 200 to illustrate the common configuration and operation in FIGS. 8 through 15, and accordingly, they are both designated as reference numeral 10 for representatively designating an switching shaft for the ground circuit switching mechanism 100 and an switching shaft for the main circuit switching mechanism 200. In FIG. 12, reference numeral 10' designates a position at which the switching shaft is provided.

Among the switching shaft levers 10-1, an end portion of the middle switching shaft lever 10-1 connected to the switching mechanism is connected to the switching shaft 10, and the other end portion thereof is connected to the first link 6.

The pivotal shaft of the first link 6 is different from that of the switching shaft lever 10-1 and an end portion of the first link 6 is connected to the switching shaft lever 10-1 like an engaging gear, and thus the switching shaft lever 10-1 and the first link 6 are rotated in an opposite direction to each other. The first link 6 provides a driving force to the middle switching shaft lever 10-1 among the three to drive the movable contactor 11 to an opening or closing position.

The second link 4 is connected to the other end portion of the first link 6, and the first link 6 and second link 4 are rotated in the same direction to each other.

The third link 3 connected by a driving connecting pin (P) to have an end portion thereof transmitting a driving force to the second link 4 is rotatably provided at the other end portion of the second link 4.

The closing spring section may comprise a closing spring 13 for providing a driving force for driving the movable contactor 11 to a closing position and a closing spring seat to which reference numeral is not assigned, and the closing spring 13 provides a driving force for driving the movable contactor 11 to a closing position by charging elastic energy and discharging the charged elastic energy.

Figure 9:
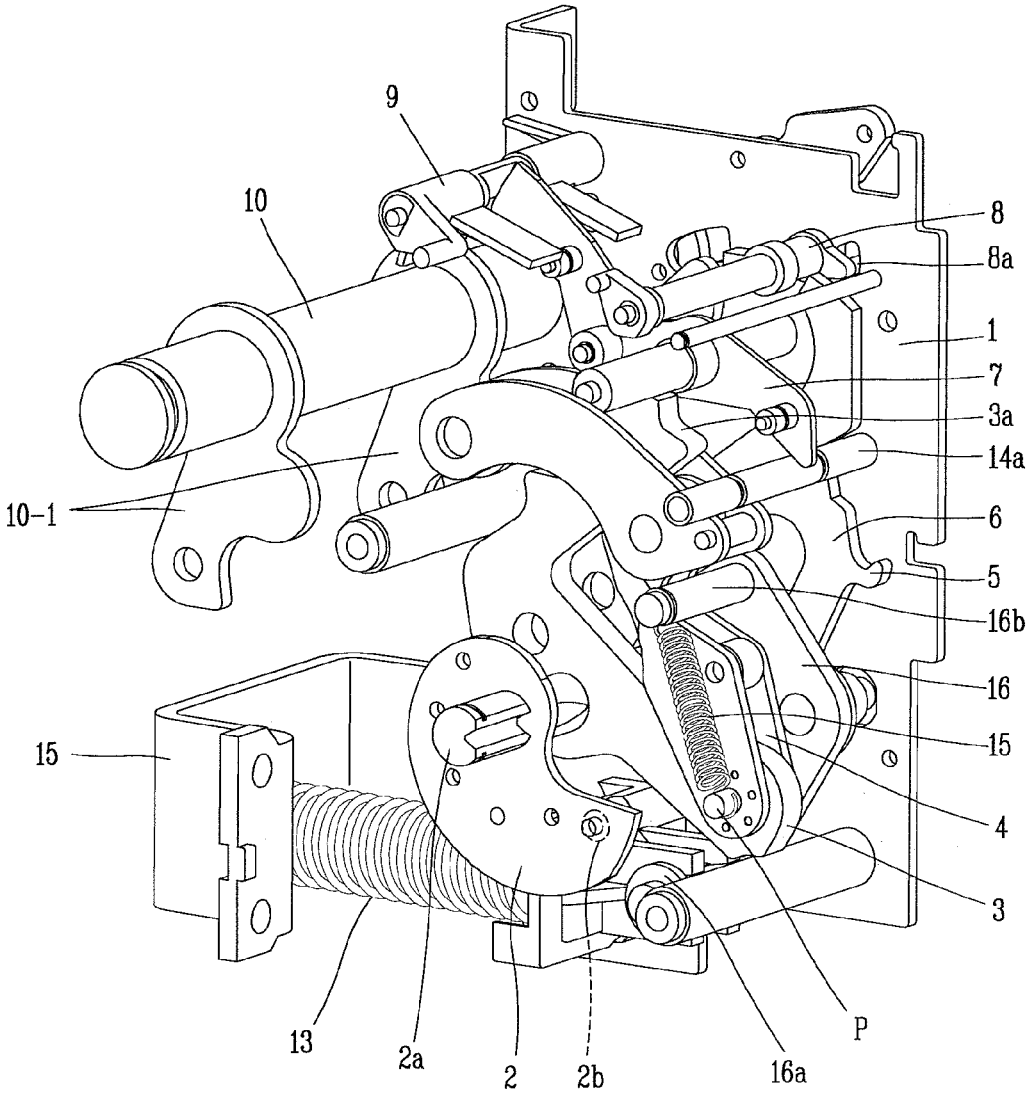
FIG. 9 is a perspective view of a switching mechanism illustrating the configuration of a main circuit switching mechanism and a ground circuit switching mechanism according to the present invention.

A closing spring supporting bracket 15 for supporting the other end portion opposite to an end portion of the closing springs 13 for providing the driving force as illustrated in FIG. 9 is provided to prevent the deviation of the closing spring 13 and support the rotation of the closing spring seat.

The ground circuit switching mechanism 100 or main circuit switching mechanism 200 may comprise a charging cam 2 providing a driving force for charging an elastic force of the closing spring section, and the charging cam 2 can be rotated together with the pivotal shaft 2*a*. The charging cam 2 is provided with a cam roller 2*b* shown by a dotted line in FIG. 9 at a side thereof.

The third link 3 is coaxially connected to the pivotal shaft 2*a* of the charging cam 2 to be rotated together.

The driving lever 16 may comprise a driving lever pin 16*b* brought into contact with the second link 4 to be drivably connected to the second link 4 as illustrated in FIG. 9, and may be configured with a pair of the driving levers 16, 16 connected to each other separately by the driving lever pin 16*b* as illustrated in FIG. 12, and the second link 4 and the third link 3 are interposed between the pair of the levers 16, 16. Furthermore, the driving lever 16 may comprise a driving lever roller shaft 16*a* connected to the closing spring section to be rotated by providing a driving force for charging elastic energy to the closing spring section through a driving lever roller shaft 16*a* or receiving elastic energy discharged from the closing spring section. Furthermore, at a position on the driving lever 16 is provided with a driving lever roller 16*c* that can be brought into contact with an outer circumferential surface of the charging cam 2 to receive a driving force for charging the closing spring 13 from the charging cam 2 as illustrated in FIG. 11.

The opening spring 14 is a spring, an end of which is supported by the switching shaft lever 10-1 and the other end of which is supported by a spring support pin (refer to reference numeral 14*a* in FIG. 9) fixed on the side plate 1. The opening spring 14 is stretched by the clockwise rotation of the switching shaft lever 10-1 to charge elastic energy during the closing operation and discharge the charged elastic energy during the circuit opening (trip operation), thereby providing a driving force for rotating the switching shaft lever 10-1 in a counter clockwise direction.

The ground circuit switching mechanism 100 or main circuit switching mechanism 200 comprises a pair of third link biasing springs 15, and an end portion of the third link biasing spring 15 is supported by a connecting pin of the first link 6 and second link 4 and the other end portion thereof is supported by a connecting pin (P) of the third link 3 and the second link 4.

Figure 10:
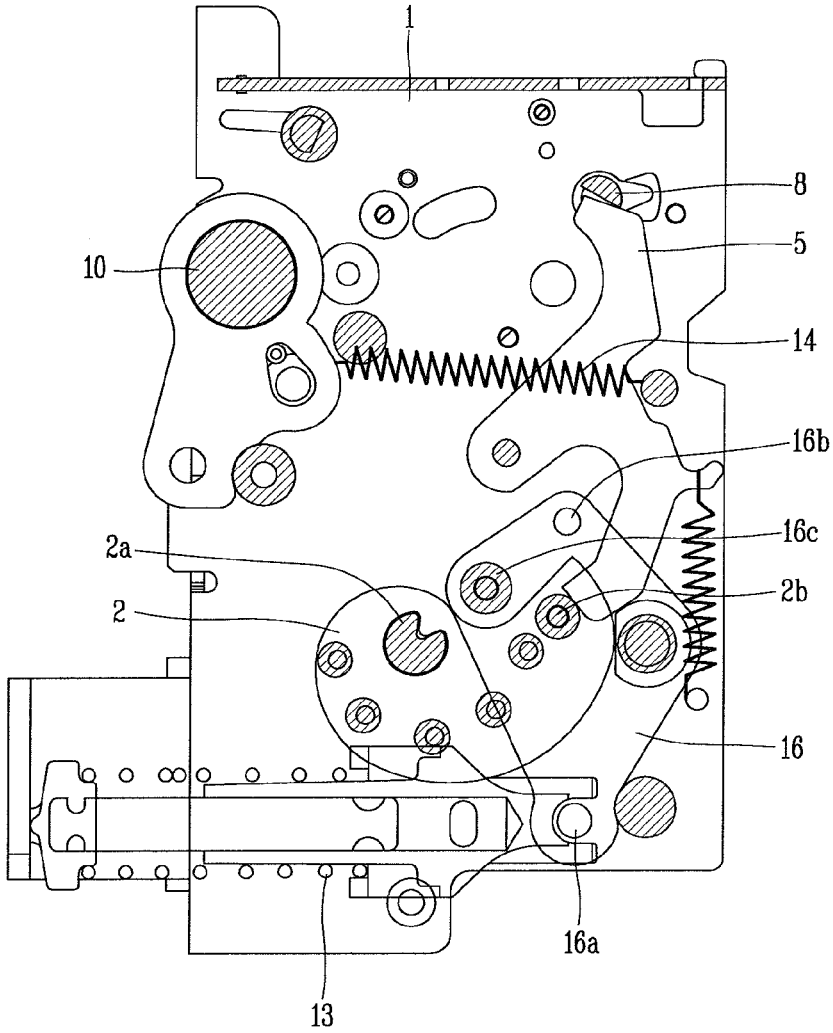
FIG. 10 is an operational state view illustrating the interlocking configuration and operation between a charging cam and a driving lever and closing latch in a main circuit switching mechanism and a ground circuit switching mechanism according to the present invention, showing a state in which a closing spring discharged an elastic energy.
Figure 11:
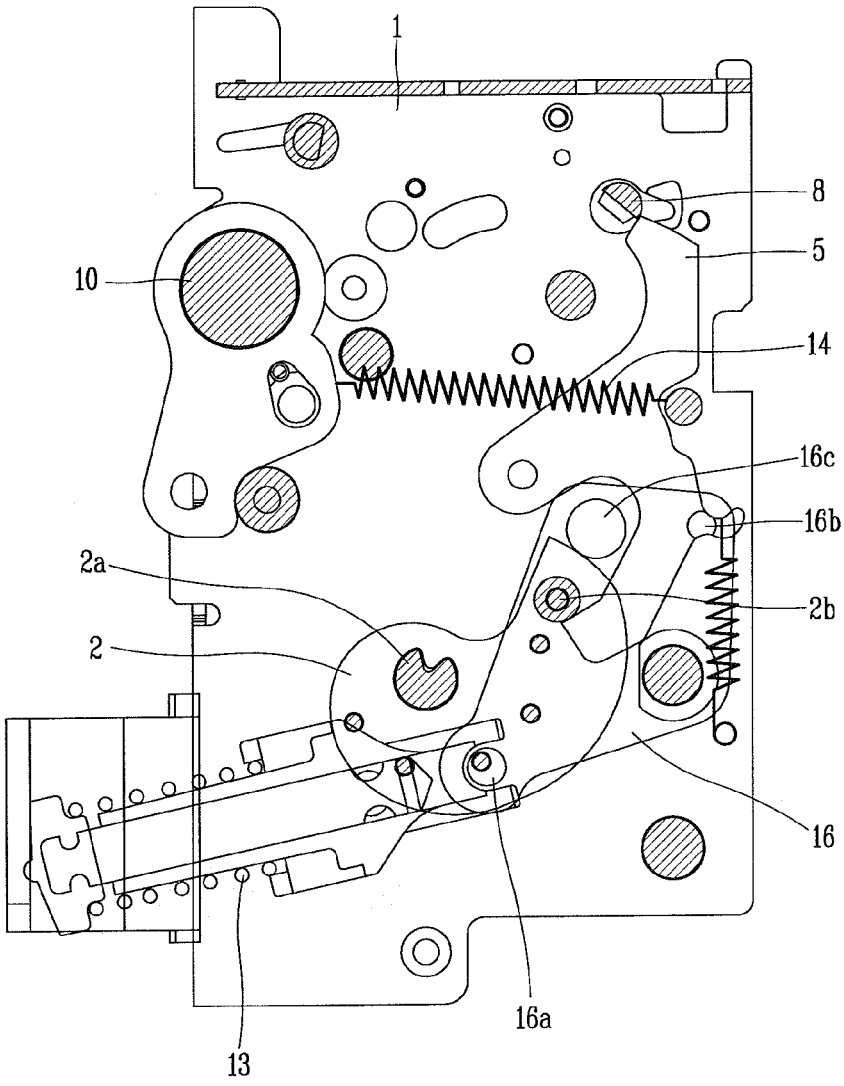
FIG. 11 is an operational state view illustrating the interlocking configuration and operation between a charging cam and a driving lever and closing latch in a main circuit switching mechanism and a ground circuit switching mechanism according to the present invention, showing a state in which the closing spring charged the elastic energy.
Figure 12:
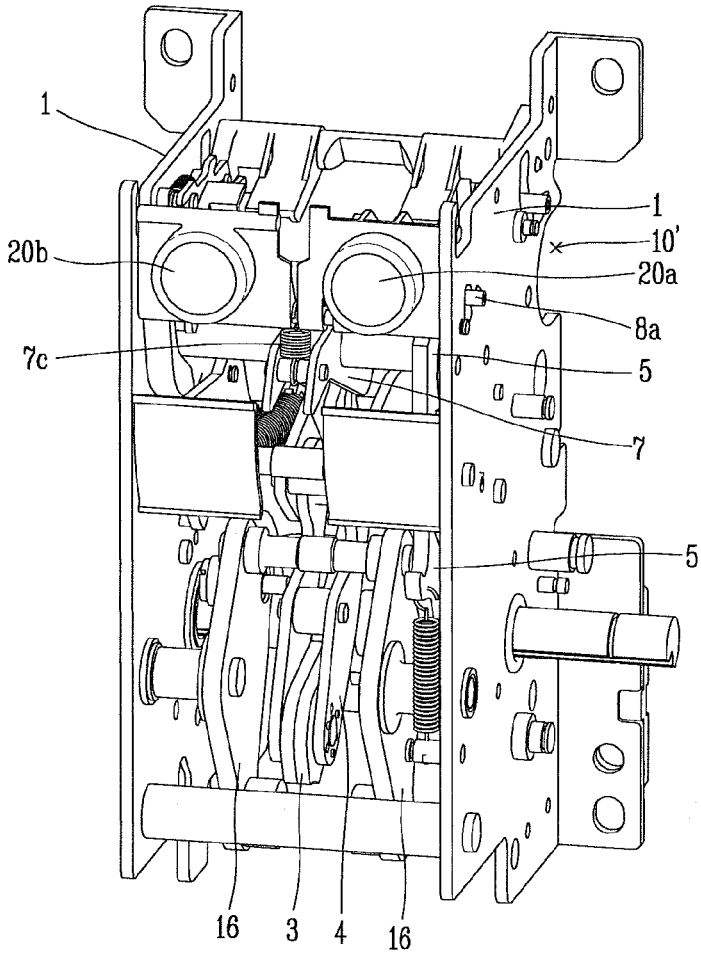
FIG. 12 is a perspective view illustrating a state in which a closing button is provided in a main circuit switching mechanism or a ground circuit switching mechanism according to the present invention.

Referring to FIGS. 10 and 11, the closing latch 5 is provided to be lengthened and extended in a vertical direction to have a surface (the bottom surface and a lower side surface) located on a moving trajectory of the cam roller 2*b* provided at a surface of the charging cam 2 to lock the rotation of the charging cam 2. An upper end portion of the closing latch 5 may be located on a rotational path of the on shaft 8, and thus locked or released by the on shaft 8. An central portion of the closing latch 5 is penetrated by a rotation shaft (to which reference numeral is not given) fixed to the side plate 1, and the closing latch 5 is rotatably supported around the rotation shaft, and a closing latch biasing spring (to which reference numeral is not given) is connected to a lower portion of one side (the right side in FIGS. 8 and 9) of the closing latch 5, and thus the closing latch 5 is imposed by an elastic force to be rotated by the closing latch biasing spring in a counter clockwise direction on the drawing.

The on shaft 8 is brought into contact with the on button (refer to reference numeral 20*a* in FIGS. 12 and 13) to be driven by manual power or connected to an electrical driving control device and actuator to be rotatably driven in an automatic manner. The on shaft 8 is configured with a substantially cylindrical-shaped shaft, and provided with a lever portion and an extended protrusion portion 8*a* extended and protruded to an outside of the side plate 1 from the relevant lever portion at an end portion thereof as illustrated in FIGS. 9 and 12. Referring to FIGS. 8 and 9, when the on shaft 8 is rotated in a counter clockwise direction, the extended protrusion portion 8*a* is lifted up within a slot portion allowing a vertical movement and being protruded to the outside at the side plate 1 to release the closing latch 5, and accordingly, the closing latch 5 is rotated in a counter clockwise direction by an elastic force of the closing latch biasing spring. When the on shaft 8 is rotated in a clockwise direction, the extended protrusion portion 8*a* of the on shaft 8 within the slot portion 1*a* of the side plate 1 is lifted down to lock the closing latch 5 not to be rotated in a counter clockwise direction.

The on/off button of the ground circuit switching mechanism 100 and main circuit switching mechanism 200 as illustrated in FIG. 1 may comprise an on button 20*a* of the ground circuit switching mechanism 100 and an on button 30*a* of the main circuit switching mechanism 200, and an off button 20*b* of the ground circuit switching mechanism 100 and an off button 30*b* of the main circuit switching mechanism 200, respectively.

Figure 13:
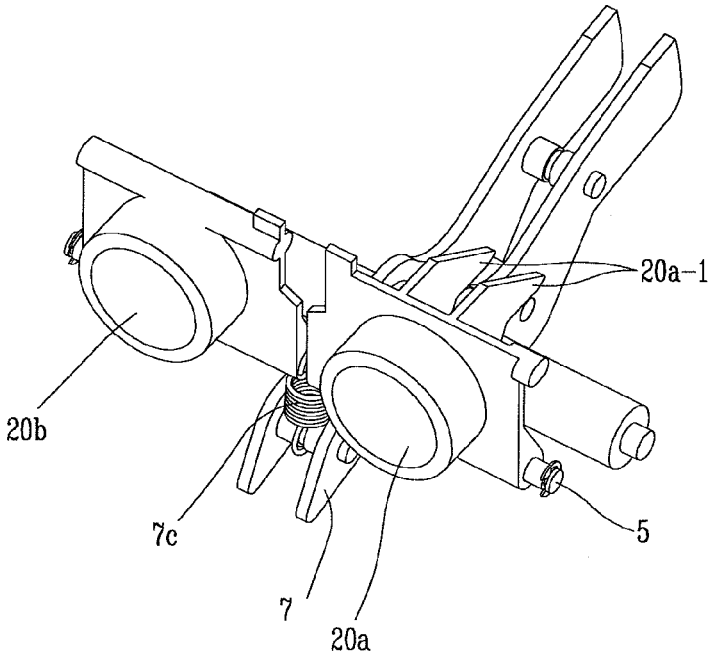
FIG. 13 is a perspective view illustrating a state in which the configuration of a closing button and an off button is individually provided in a main circuit switching mechanism or a ground circuit switching mechanism according to the present invention.

Referring to FIG. 13, the on button 20*a* of the ground circuit switching mechanism 100, representatively, in the ground circuit switching mechanism 100 and main circuit switching mechanism 200, may comprise a button portion, a button pivotal shaft 5 rotatably supporting the button portion, a tilt portion 20*a*-1 extended to the rear side and inclined downward as moving toward the rear side. When the user presses the on button 20*a*, the on shaft 8 is lifted up along the tilt portion 20*a*-1 while being brought into contact with and pressed by the tilt portion 20*a*-1 of the on button 20*a* as illustrated in FIG. 9, and at the same time the closing latch 5 is released and the extended protrusion portion 8*a* of the on shaft 8 is also lifted up.

Figure 14:
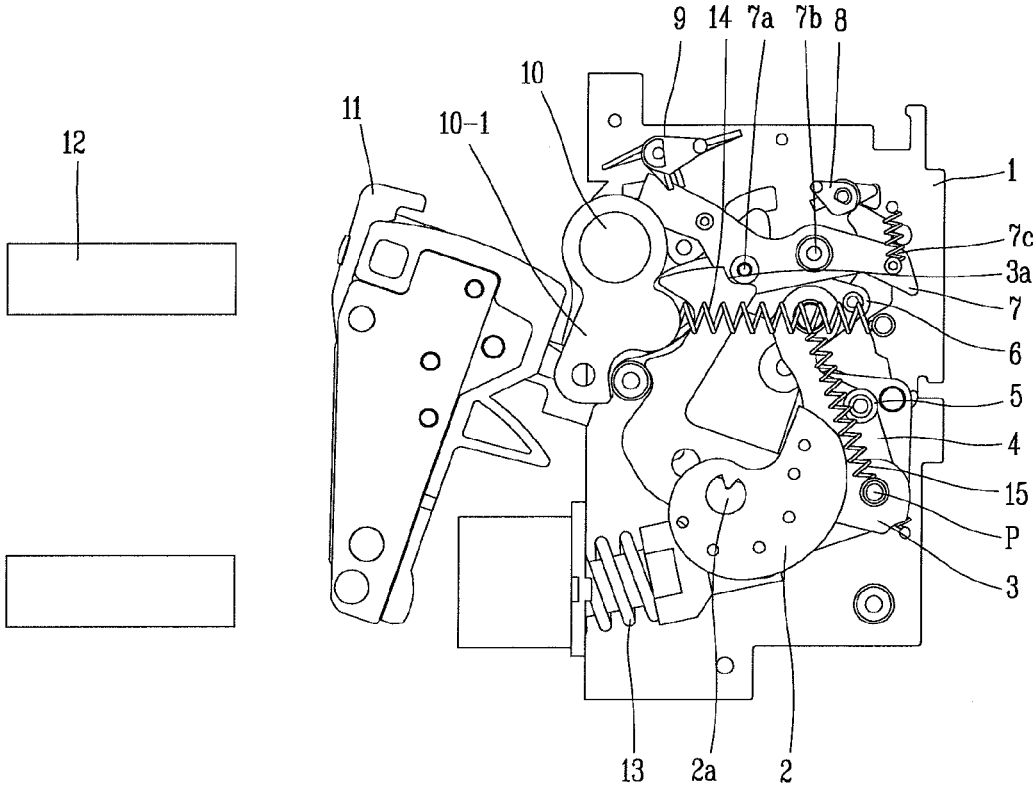
FIG. 14 is an operational state view illustrating a state in which a closing spring providing a driving force for the closing or grounding operation is charged the elastic energy in a main circuit switching mechanism or a ground circuit switching mechanism according to the present invention.
Figure 15:
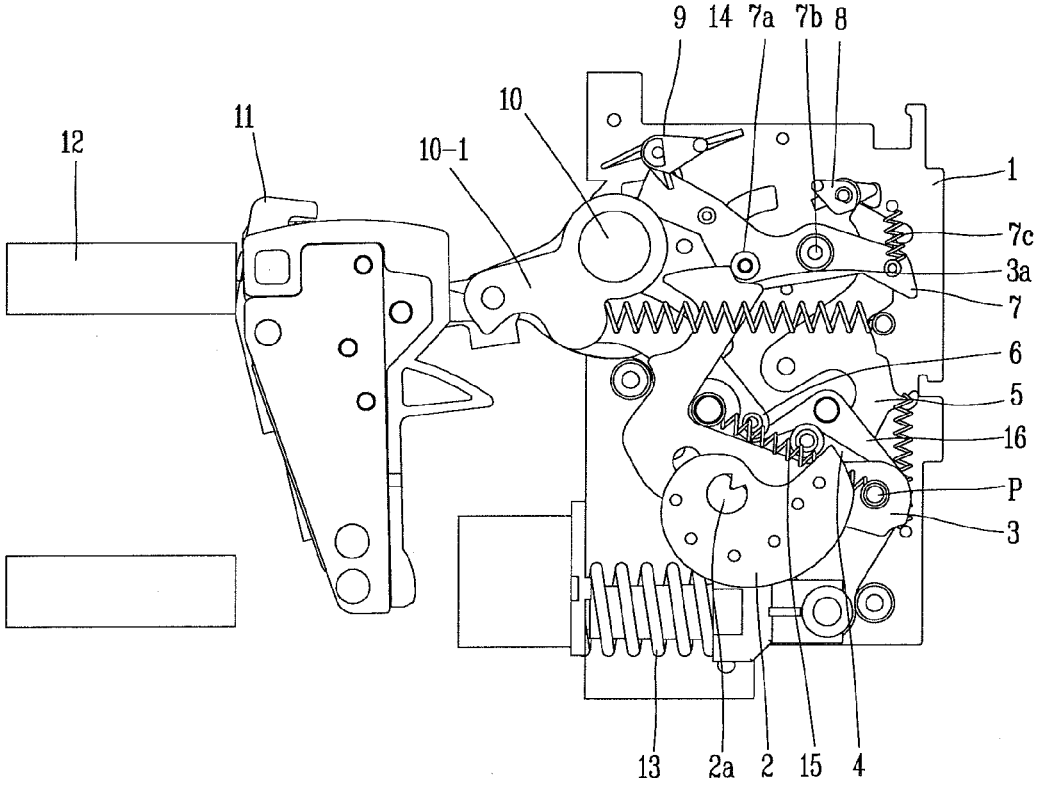
FIG. 15 is an operational state view illustrating a state in which a closing spring is discharged to complete the closing or grounding operation in a main circuit switching mechanism or a ground circuit switching mechanism according to the present invention.

A groove portion 3*a* is provided at an upper portion of the third link 3. A opening latch roller 7*a* that can be moved to a position to enter into or get out of the groove portion 3*a* of the third link 3 is provided therewith and the opening latch 7 that can be rotated around the rotation shaft 7*b* thereof is provided at an upper portion of the third link 3. An end portion of the opening latch 7 is connected to an opening latch spring 7*c* by a pin and thus the opening latch 7 receives an elastic biasing force for rotating in a counter clockwise direction from the opening latch spring 7*c* as illustrated in FIGS. 8, 14, and 15.

An off shaft 9 is rotatably provided to be brought into contact with the other upper end portion of the opening latch 7 in a length direction, and the rotation of the opening latch 7 is locked or released by the off shaft 9.

The operation of the ground circuit switching mechanism 100 or main circuit switching mechanism 200 having the foregoing configuration will be described below by dividing into a charging (elastic force charging) operation, a closing operation, and an opening operation of the closing spring.

First, the charging operation of the closing spring will be described with reference to FIG. 11.

The pivotal shaft 2*a* of the charging cam 2 is rotated by a manipulation handle which is not shown herein or a motor which is not shown herein in a counter clockwise direction on the drawing.

Then, the driving lever roller 16*c* of the driving lever 16 brought into contact with an outer surface of the charging cam 2 is pressed as increasing a curvature radius of the outer surface of the charging cam 2, and thus the driving lever 16 is rotated in a clockwise direction from the position illustrated in FIG. 10 as illustrated in FIG. 11. Then, the spring seat of the closing spring section connected by the driving lever roller shaft 16*a* of the driving lever 16 rotated in a clockwise direction presses and compresses the closing spring 13 while being moved to the left side as illustrated in FIG. 11, and accordingly, the closing spring 13 charges elastic energy for the closing operation.

At this time, the charging cam 2 is rotated until the cam roller 2*b* provided at a surface of the charging cam 2 is brought into contact with a lower end portion surface of the closing latch 5.

According to the counter clockwise rotation of the charging cam 2, the third link 3 and second link 4 are linked thereto and rotated in a counter clockwise direction.

At this time, the rotation of the switching shaft 10 is locked by the opening latch 7, and it maintains a state in which the movable contactor 11 is separated from the fixed contactor 12 as illustrated in FIG. 14.

In other words, while the third link 3 is rotated in a counter clockwise direction the roller 7*a* of the opening latch 7 is entered into the groove portion 3*a* of the third link 3, and thus the counter clockwise rotation of the third link 3 is locked.

While the cam roller 2*b* provided on a surface of the charging cam 2 is brought into contact with the closing latch 5, the cam roller 2*b* presses the closing latch 5 and the closing latch 5 is rotated in a clockwise direction around its rotation shaft. The clockwise rotation of the closing latch 5 is obstructed by the on shaft 8 to complete the charging operation of the closing spring 13.

On the other hand, the closing operation of the ground circuit switching mechanism 100 or main circuit switching mechanism 200 will be described below with reference to FIGS. 10 and 15.

As illustrated in FIG. 1 or FIGS. 12 and 13, when the on shaft 8 is connected to the on button 20*a* to be driven upward by manual power or connected to an electrical driving control device and actuator to be driven upward in an automatic manner, the closing latch 5 is released from the lock by the on shaft 8 and rotated in a counter clockwise direction from the position illustrated in FIG. 11 to the position illustrated in FIG. 10 by an elastic force of the closing latch biasing spring.

As the closing latch 5 is released, the lock of the cam roller 2*b* by the closing latch 5 is also released.

Accordingly, the driving lever 16 is pressed by the spring seat of the closing spring 13 and the driving lever roller 16*a* when the closing spring 13 discharges and thus the driving lever 16 is rotated in a counter clockwise direction and as a result the driving lever pin 16*b* presses the second link 4 to be rotated in a counter clockwise direction on the drawing as illustrated in FIG. 9. The third link 3 is also rotated in a counter clockwise direction by the counter clockwise rotation of the second link 4, and accordingly, the first link 6 is pressed to be pushed and lifted up by the second link 4 to be rotated in a counter clockwise direction.

The switching shaft lever 10-1 and first link 6 are connected to each other in an interlocked manner, and thus the switching shaft lever 10-1 is interlocked with the first link 6 by the counter clockwise rotation of the first link 6 to be rotated in a clockwise direction while at the same time the switching shaft 10 is rotated in a clockwise direction. As a result, the movable contactor 11 connected to be interlocked with the switching shaft lever 10-1 is rotated in a counter clockwise direction in FIG. 15 to contact with the fixed contactor 12 and thus the circuit is closed. In other words, it is grounded in case of the ground circuit switching mechanism 100, and a circuit between the electric power source side and electric load side thereof in case of the main circuit switching mechanism 200 is closed to be in a conductive state.

Meanwhile, the circuit opening operation of the ground circuit switching mechanism 100 or main circuit switching mechanism 200 will be described below with reference to FIG. 8.

Referring to FIGS. 12 and 13, when the off shaft 9 is connected to the off button 20*b* through a power transmission mechanism to which reference numeral is not given to be rotatably driven by manual power in a clockwise direction as illustrated in FIG. 8 or connected to an electrical driving control device and actuator to be rotatably driven in an automatic manner in a clockwise direction, the opening latch 7 is released from the lock by the off shaft 9 and rotated in a counter clockwise direction by an elastic force of the opening latch spring 7*c*, and also released from the lock by the groove portion 3*a* of the third link 3.

As the third link 3 is released from the lock by the opening latch 7, the interlocked the second link 4 and first link 6 are also released, and the opening spring 14 discharges the charged elastic energy while the supporting end portion at the side of the switching shaft lever 10-1 thereof is restored to the side of the spring support pin 14*a* of the side plate 1 in a stretched state during the closing operation to rotate the switching shaft lever 10-1 in a counter clockwise direction, and accordingly, the movable contactor 11 is separated from the fixed contactor 12 while being rotated in a clockwise direction. As a result, the conduction circuit is open. In other words, it is separated from the earth in case of the ground circuit switching mechanism 100, and a circuit between the electric power source side and electric load side thereof is open in case of the main circuit switching mechanism 200.

On the other hand, the configuration and operation of the interlock apparatus 40 for a solid-insulated switchgear according to the present invention, the solid-insulated switchgear having the main circuit switching mechanism 200 and ground circuit switching mechanism 100 configured and operated as described above will be described mainly with reference to FIGS. 1 through 7 and in auxiliary manner with reference to FIGS. 8 through 15.

The interlock apparatus 40 according to the present invention may comprise a first interlock mechanism interlocked with the closing (i.e., grounding) operation of the switching shaft 10*a* of the ground circuit switching mechanism 100 to press or release the on shaft 8 of the main circuit switching mechanism 200 so as to be in a locking position but not allowed to be operated to a closing position or a second interlock mechanism interlocked with the closing operation of the switching shaft 10*b* of the main circuit switching mechanism 200 to press or release the on shaft of the ground circuit switching mechanism 100 so as to be in a locking position but not allowed to be operated to a closing position (i.e., ground position). In locking the corresponding on shaft of the switching mechanism to prevent the ground circuit switching mechanism 100 and main circuit switching mechanism 200 from performing the closing operation at the same time by interlocking with the closing operation (rotated in a closing direction) of the switching shaft of the ground circuit switching mechanism 100 or the switching shaft of the main circuit switching mechanism 200, the first interlock mechanism and second interlock mechanism are provided at a middle portion in a horizontal direction between the ground circuit switching mechanism 100 and main circuit switching mechanism 200 at a position where the switching shaft of the ground circuit switching mechanism 100 and main circuit switching mechanism 200 and an end portion of the on shaft are located at a substantially extended line on a vertical direction to effectively mechanically transmit the rotational power in a closing direction of either one of the switching shafts of the ground circuit switching mechanism 100 and main circuit switching mechanism 200 to the on shaft of the counterpart switching mechanism in the shortest distance.

Figure 2:
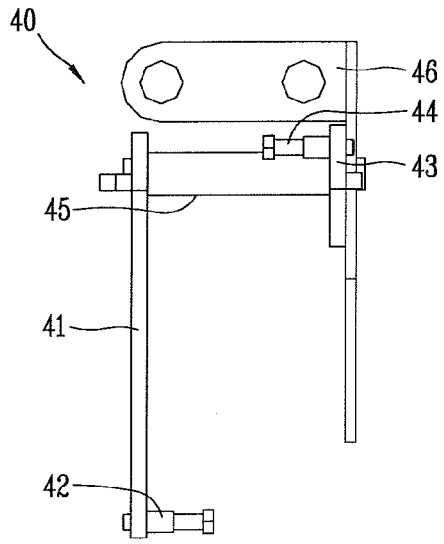
FIG. 2 is a front view illustrating the configuration of an interlock apparatus according to the present invention.
Figure 3:
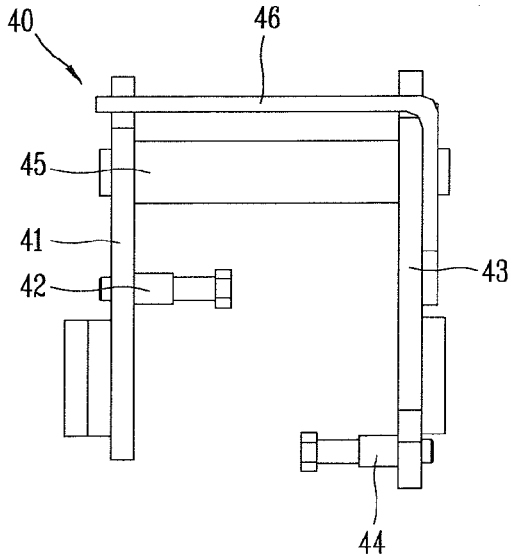
FIG. 3 is a top view illustrating an interlock apparatus according to the present invention.

Referring to FIGS. 1 through 7, the interlock apparatus 40 according to the present invention may further comprise a supporting base 46. The supporting base 46, as a means supporting the first interlock mechanism and second interlock mechanism, is made of a metal plate and an upper portion of one plate is bent at right angle and configured with an alphabet "L"-shaped plate. The supporting base 46 may be fixed of which the upper right angle bent portion fixed by screw fastening of the with a bolt and a nut to a fixing flange portion of the facing side plates 1 of the ground circuit switching mechanism 100 and main circuit switching mechanism 200. For this purpose, as illustrated in FIG. 2, the supporting base 46 may comprise a pair of bolt holes separated from each other in a horizontal direction on the upper front surface thereof.

Referring to FIGS. 2 through 5, the first interlock mechanism may comprise a first driving lever 43 and a power transmission spring 47.

Figure 4:
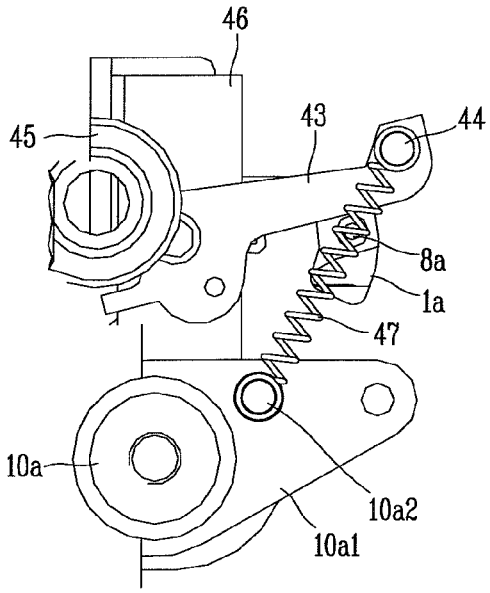
FIG. 4 is an operational state view illustrating an operation state in which a first interlock mechanism of the interlock apparatus according to the present invention has released an on shaft of the main circuit switching mechanism.
Figure 5:
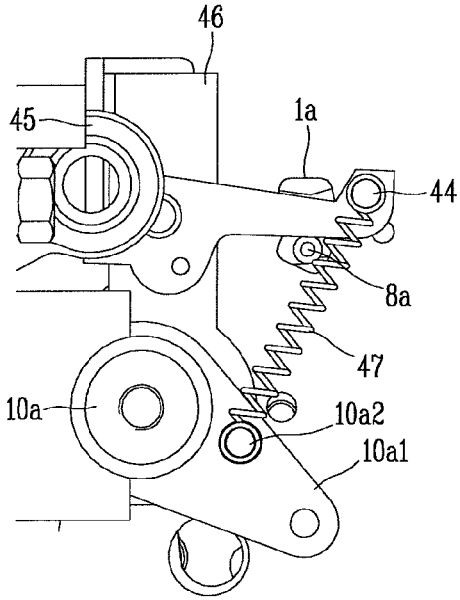
FIG. 5 is an operational state view illustrating an operation state in which a first interlock mechanism of the interlock apparatus according to the present invention has locked an on shaft of the main circuit switching mechanism.

The first driving lever 43 presses the on shaft 8 of the main circuit switching mechanism 200, more specifically, presses the extended protrusion portion 8*a* of the on shaft 8 to lock the on shaft 8 or releases the pressure on the extended protrusion portion 8*a* of the on shaft 8 to release the on shaft 8 of the main circuit switching mechanism 200. The first driving lever 43, as illustrated in FIGS. 2 through 5, particularly illustrated in FIGS. 4 and 5, is a lever which is axially supported by a rotation shaft (to which reference numeral is not given) fixed and provided on the supporting base 46 to be rotated around the corresponding rotation shaft. The installation position of the first driving lever 43 is determined such that the lower portion surface thereof can be brought into contact with the extended protrusion portion 8*a* of the on shaft 8 within the rotation radius. Referring to FIGS. 4 and 5, the first driving lever 43 may comprise a support pin 44 for supporting an end portion of the first power transmission spring 47 at the free end portion thereof. The first power transmission spring 47 is connected between the switching shaft lever 10*a*1 of the ground circuit switching mechanism 100 and the first driving lever 43 to transmit a driving force to the first driving lever 43 such that the first driving lever 43 is rotated to a position for locking the on shaft 8 of the main circuit switching mechanism 200 when the switching shaft lever 10*a*1 of the ground circuit switching mechanism 100 is rotated to a ground position by the switching shaft 10*a*. The switching shaft lever 10*a*1 of the ground circuit switching mechanism 100 may comprise a support pin 10*a*2 supporting the other end portion of the first power transmission spring 47, and thus both end portions of the first power transmission spring 47 are supported by the support pin 44 of the first driving lever 43 and the support pin 10*a*2 of the switching shaft lever 10*a*1.

Meanwhile, as illustrated in FIGS. 1, 2, 6, and 7, the second interlock mechanism may comprise a second driving lever 45 and a power transmission mechanism 48, 41.

Figure 6:
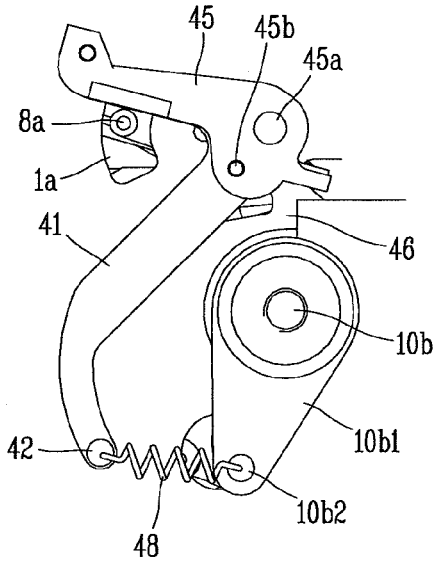
FIG. 6 is an operational state view illustrating an operation state in which a second interlock mechanism of the interlock apparatus according to the present invention has released an on shaft of the ground circuit switching mechanism.
Figure 7:
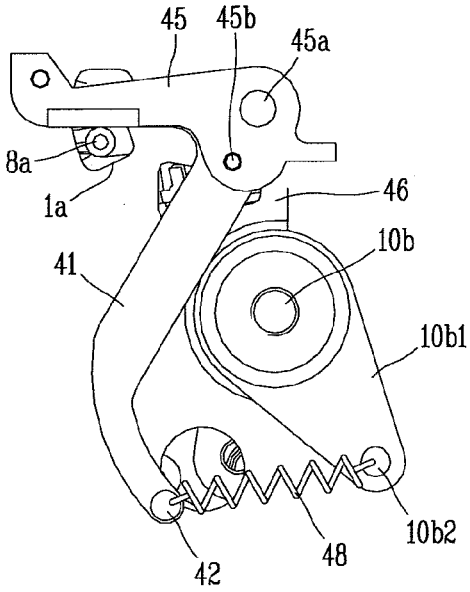
FIG. 7 is an operational state view illustrating an operation state in which a second interlock mechanism of the interlock apparatus according to the present invention has locked an on shaft of the ground circuit switching mechanism.

The second driving lever 45 is a means for pressing the on shaft 8 of the ground circuit switching mechanism 100, more specifically, pressing the extended protrusion portion 8*a* of the on shaft 8 to lock the on shaft 8 or release the on shaft 8 of the ground circuit switching mechanism 100. The second driving lever 45, as illustrated in FIGS. 2 through 4, 6 and 7, particularly illustrated in FIGS. 6 and 7, is a lever which is axially supported by a rotation shaft 45*a* fixed and provided on the supporting base 46 to be rotated around the rotation shaft 45*a*. The installation position of the second driving lever 45 is determined such that the lower portion surface thereof can be brought into contact with the extended protrusion portion 8*a* of the on shaft 8 within the rotation radius. Referring to FIGS. 6 and 7, the second driving lever 45 may comprise a connecting key 45*b* for connecting a link 41 to a portion adjacent to the rotation shaft 45*a*. The connecting key 45*b* may comprise a pin provided to penetrate the second driving lever 45 and link 41 and a key portion (not shown) inserted perpendicular to an axial direction of the pin. The connecting key 45*b* is a means for connecting the second driving lever 45 and link 41 together to be rotated in the same direction, and other modified embodiments can be implemented if it is a connecting means for performing the relevant function.

The power transmission mechanism 48, 41 is connected between the switching shaft lever 10*b*1 of the main circuit switching mechanism 200 and the second driving lever 45 to transmit a driving force to the second driving lever 45 such that the second driving lever 45 is rotated to a position for locking the on shaft 8 of the ground circuit switching mechanism 100 when the switching shaft lever 10*b*1 of the main circuit switching mechanism 200 is rotated to a closing position by the switching shaft 10*b*. The power transmission mechanism 48, 41 may comprise a second power transmission spring 48 and a link 41.

An end portion of the second power transmission spring 48 is connected to the switching shaft lever 10*b*1 of the main circuit switching mechanism 200 to transmit a rotational driving force from the switching shaft lever 10*b*1 in the main circuit switching mechanism 200.

The link 41 may comprise an end portion of which is connected to the other end portion of the second power transmission spring 48 and the other end portion of which is connected to the second driving lever 45 to transmit a driving force from the second power transmission spring 48 to the second driving lever 45.

The link 41 and the switching shaft lever 10*b*1 of the main circuit switching mechanism 200 may comprise a support pin supporting both end portions of the second power transmission spring 48, respectively. The support pin of the second driving lever 45 is designated by reference numeral 42, and the support pin of the switching shaft lever 10*b*1 designated by reference numeral 10*b*2.

The configuration and operation of the interlock apparatus for a solid-insulated switchgear according to the present invention, having the foregoing configuration will be described mainly with reference to FIGS. 4 through 7 and in auxiliary manner with reference to FIGS. 1 through 3 and FIGS. 8 through 15.

First, the operation of an interlock apparatus for a solid-insulated switchgear according to the present invention in which the main circuit switching mechanism 200 is interlocked to prevent it from being closed when the ground circuit switching mechanism 100 is operated to a closed, namely, ground position will be described mainly with reference to FIGS. 4 and 5 and in auxiliary manner with reference to FIGS. 1 through 3 and FIGS. 8 through 15.

The switching shaft lever 10*a*1 of the ground circuit switching mechanism 100 has a location where the switching shaft lever 10*a*1 designates a substantially 3 o'clock direction when it is not at a closing position as illustrated in FIG. 4. In this state, if the ground circuit switching mechanism 100 is operated to a closing position, then the switching shaft lever 10*a*1 is rotated in a clockwise direction from the position as illustrated in FIG. 4 to the position as illustrated in FIG. 5 to be located at a position indicating a substantially 5 o'clock direction.

Then, a driving force according to the clockwise rotation of the switching shaft lever 10*a*1 is transferred to the first driving lever 43 through the first power transmission spring 47, and accordingly, the first driving lever 43 is also rotated in a clockwise direction.

The first driving lever 43 presses the extended protrusion portion 8*a* of the on shaft 8 in the main circuit switching mechanism 200 by a lower surface thereof while being rotated in a clockwise direction, and accordingly, the extended protrusion portion 8*a* of the on shaft 8 in the main circuit switching mechanism 200 is lifted down within the range limited by a lower end boundary surface of the slot portion 1*a* of the side plate 1 in the main circuit switching mechanism 200.

Accordingly, the on shaft 8 is in a state of locking the closing latch 5 as illustrated in FIG. 11 even when the user presses the on button 30*a* of the main circuit switching mechanism 200 as illustrated in FIG. 1, and thus, as the closing latch 5 locks the charging cam 2 through the cam roller 2*b* to prevent it from being rotated, and accordingly, the third link 3 and second link 4 coaxially connected to the charging cam 2 is also locked to prevent it from being rotated, and the driving lever 16 brought into contact with to an outer surface of the second link 4 through the driving lever pin 16*b* cannot be rotated to maintain a stationary state. Accordingly, the closing spring 13 is locked in a state that elastic energy providing a closing driving force is charged as illustrated in FIG. 11, and the main circuit switching mechanism 200 maintains a standby state for the closing operation but does not perform the closing operation.

As a result, when the ground circuit switching mechanism 100 is in a closed state, namely, a ground state, by an interlock apparatus for an solid-insulated switchgear according to the present invention, the main circuit switching mechanism 200 cannot be in a closed state, namely, a state in which a current flows from the electric power source side to the electric load side on a power circuit, thereby preventing an electrical safety accident from being occurred.

Next, the operation of an interlock apparatus for a solid-insulated switchgear according to the present invention in which the ground circuit switching mechanism 100 is interlocked to prevent it from being operated to a closing position, namely, a ground position, when the main circuit switching mechanism 200 is operated to a closing position will be described mainly with reference to FIGS. 6 and 7 and in auxiliary manner with reference to FIGS. 1 through 3 and FIGS. 8 through 15.

The switching shaft lever 10*b*1 of the main circuit switching mechanism 200 has a location where the switching shaft lever 10*b*1 designates a substantially 6 o'clock direction when it is not at a closing position as illustrated in FIG. 6. In this state, if the main circuit switching mechanism 200 is operated to a closing position, then the switching shaft lever 10*b*1 is rotated in a counter clockwise direction from the position as illustrated in FIG. 6 to the position as illustrated in FIG. 7 to be located at a position indicating a substantially 5 o'clock direction.

Then, a driving force according to the counter clockwise rotation of the switching shaft lever 10*b*1 is transferred to the second driving lever 45 through the second power transmission spring 48 and link 41, and accordingly, the second driving lever 45 is also rotated in a counter clockwise direction.

The second driving lever 45 presses the extended protrusion portion 8*a* of the on shaft 8 in the ground circuit switching mechanism 100 by a lower surface thereof while being rotated in a counter clockwise direction, and accordingly, the extended protrusion portion 8*a* of the on shaft 8 in the ground circuit switching mechanism 100 is lifted down within the range limited by a lower end boundary surface of the slot portion 1*a* of the side plate 1 in the ground circuit switching mechanism 100.

Accordingly, the on shaft 8 is in a state of locking the closing latch 5 as illustrated in FIG. 11 even when the user presses the on button 20*a* of the ground circuit switching mechanism 100 as illustrated in FIG. 1, and thus, as the closing latch 5 locks the charging cam 2 through the cam roller 2*b* to prevent it from being rotated, and accordingly, the third link 3 and second link 4 coaxially connected to the charging cam 2 is also locked to prevent it from being rotated, and the driving lever 16 brought into contact with to an outer surface of the second link 4 through the driving lever pin 16*b* cannot be rotated to maintain a stationary state. Accordingly, the closing spring 13 is locked in a state that elastic energy providing a closing driving force is charged as illustrated in FIG. 11, and the main circuit switching mechanism 200 maintains a standby state for the closing operation but does not perform the closing operation.

As a result, when the main circuit switching mechanism 200 is in a closed state, by an interlock apparatus for an solid-insulated switchgear according to the present invention, the ground circuit switching mechanism 100 cannot be in a closed state, namely, a ground state, thereby preventing an electrical safety accident from being occurred.

As described above, an interlock apparatus for a solid-insulated switchgear according to the present invention is suitable in applying a solid-insulated switchgear in which a main circuit switching mechanism and a ground circuit switching mechanism are disposed laterally in a horizontal direction, thereby providing fabrication productivity, reducing the fabrication cost, and miniaturizing the overall solid-insulated switchgear with a simple structure.

An interlock apparatus for a solid-insulated switchgear according to the present invention has a configuration in which a first interlock mechanism and a second interlock mechanism are provided between the main circuit switching mechanism and ground circuit switching mechanism disposed laterally in a horizontal direction, thereby providing an interlock apparatus suitable for the main circuit switching mechanism and ground circuit switching mechanism provided laterally in a horizontal direction.

According to an interlock apparatus for a solid-insulated switchgear according to the present invention, the first interlock mechanism may comprise a first driving lever configured to press and lock the on shaft of the main circuit switching mechanism or release the on shaft of the main circuit switching mechanism, and a first power transmission spring connected between the switching shaft lever of the ground circuit switching mechanism and the first driving lever to transmit a driving force to the first driving lever such that the first driving lever is rotated to a position for locking the on shaft of the main circuit switching mechanism when the switching shaft lever of the ground circuit switching mechanism is rotated to a ground position, thereby miniaturizing the size of the apparatus and providing simple maintenance.

According to an interlock apparatus for a solid-insulated switchgear according to the present invention, the first driving lever and the switching shaft lever of the ground circuit switching mechanism are provided with a support pin supporting both end portions of the first power transmission spring, respectively, thereby providing simple installation and location maintenance for the first power transmission spring.

According to an interlock apparatus for a solid-insulated switchgear according to the present invention, the second interlock mechanism may comprise a second driving lever configured to press and lock the on shaft of the ground circuit switching mechanism or release the on shaft of the ground circuit switching mechanism, and a power transmission mechanism connected between the switching shaft lever of the main circuit switching mechanism and the second driving lever to transmit a driving force to the second driving lever such that the second driving lever is rotated to a position for locking the on shaft of the ground circuit switching mechanism when the switching shaft lever of the main circuit switching mechanism is rotated to a closing position, thereby obtaining an effect in which the on shaft of the ground circuit switching mechanism is locked by the second driving lever when the switching shaft lever of the main circuit switching mechanism is rotated to a closing position to prevent an electrical safety accident.

According to an interlock apparatus for a solid-insulated switchgear according to the present invention, the power transmission mechanism may comprise a second power transmission spring, an end portion of which is connected to the switching shaft lever of the main circuit switching mechanism to transmit a rotational driving force of the switching shaft lever of the main circuit switching mechanism and a link having an end portion of which is connected to the other end portion of the second power transmission spring and the other end portion of which is connected to the second driving lever to transmit a driving force from the second power transmission spring to the second driving lever, thereby obtaining an effect in which the rotational driving force of the closing shaft lever in the main circuit switching mechanism is transferred to the second driving lever through the second power transmission spring.

According to an interlock apparatus for a solid-insulated switchgear according to the present invention, the link and the switching shaft lever of the main circuit switching mechanism may be provided with a support pin supporting both end portions of the second power transmission spring, respectively, thereby providing simple installation and location maintenance for the second power transmission spring.

What is claimed is:

1. An interlock apparatus for a solid-insulated switchgear having a main circuit switching mechanism and a ground circuit switching mechanism, wherein the main circuit switching mechanism and ground circuit switching mechanism are provided laterally in a horizontal direction and each include a switching shaft, a switching shaft lever supported by the switching shaft to be rotated together, a closing button for manual closing operation, an on-shaft connected to the closing button and having a released position for moving the main circuit switching mechanism to a closing position and the ground circuit switching mechanism to a ground position, and a locking position for locking the main circuit switching mechanism and ground circuit switching mechanism such that the main circuit switching mechanism is prevented from moving to a closing position simultaneously with the ground circuit switching mechanism moving to a ground position, the interlock apparatus comprising:

a first interlock mechanism provided between the main circuit switching mechanism and ground circuit switching mechanism and connected to the switching shaft of the ground circuit switching mechanism in an interlocking manner to press the on-shaft of the main circuit switching mechanism into the locking position or to release the on-shaft on shaft of the main circuit switching mechanism; and a second interlock mechanism provided between the main circuit switching mechanism and ground circuit switching mechanism and connected to the switching shaft of the main circuit switching mechanism in an interlocking manner to press the on-shaft of the ground circuit switching mechanism into the locking position or to release the on-shaft of the ground circuit switching mechanism.

2. The apparatus of claim 1, wherein the first interlock mechanism comprises:

a first driving lever configured to press and lock the on-shaft of the main circuit switching mechanism or to release the on-shaft of the main circuit switching mechanism; and a first power transmission spring connected between the switching shaft lever of the ground circuit switching mechanism and the first driving lever to transmit a driving force to the first driving lever such that the first driving lever is rotated to a position for locking the on-shaft of the main circuit switching mechanism when the switching shaft lever of the ground circuit switching mechanism is rotated to a ground position.

3. The apparatus of claim 2, wherein the first driving lever is provided with a first support pin and the switching shaft lever of the ground circuit switching mechanism is provided with a second support pin, each of which support an end portion of the first power transmission spring.

4. The apparatus of claim 1, wherein the second interlock mechanism comprises:

a second driving lever configured to press and lock the on-shaft of the ground circuit switching mechanism or to release the on-shaft of the ground circuit switching mechanism; and a power transmission mechanism connected between the switching shaft lever of the main circuit switching mechanism and the second driving lever to transmit a driving force to the second driving lever such that the second driving lever is rotated to a position for locking the on-shaft of the ground circuit switching mechanism when the switching shaft lever of the main circuit switching mechanism is rotated to a closing position.

5. The apparatus of claim 4, wherein the power transmission mechanism comprises:

a second power transmission spring, a first portion of which is connected to the switching shaft lever of the main circuit switching mechanism to transmit a rotational driving force of the switching shaft lever of the main circuit switching mechanism; and a link, a first end portion of which is connected to a second end portion of the second power transmission spring and the second end portion of which is connected to the second driving lever to transmit a driving force from the second power transmission spring to the second driving lever.

6. The apparatus of claim 5, wherein the link is provided with a third support pin and the switching shaft lever of the main circuit switching mechanism is provided with a fourth support pin, each of which support an end portion of the second power transmission spring.

7. The apparatus of claim 1, further comprising:

a supporting base configured to support the first interlock mechanism and the second interlock mechanism.

* * * * *